US007420529B2

(12) United States Patent
Abe et al.

(10) Patent No.: US 7,420,529 B2
(45) Date of Patent: Sep. 2, 2008

(54) ORGANIC EL PANEL DRIVE CIRCUIT AND ORGANIC EL DISPLAY DEVICE

(75) Inventors: Shinichi Abe, Kyoto (JP); Jun Maede, Kyoto (JP); Akio Fujikawa, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 778 days.

(21) Appl. No.: 10/899,082

(22) Filed: Jul. 27, 2004

(65) Prior Publication Data

US 2005/0024300 A1 Feb. 3, 2005

(30) Foreign Application Priority Data

Jul. 28, 2003 (JP) ..... 2003-280861

(51) Int. Cl.
*G09G 3/30* (2006.01)

(52) U.S. Cl. ..... 345/76; 315/169.3

(58) Field of Classification Search ..... 345/76, 345/77, 82, 84, 85, 90, 92, 204; 315/169.1, 315/169.3
See application file for complete search history.

(56) References Cited

U.S. PATENT DOCUMENTS 7,026,766 B2 * 4/2006 Maede et al. ..... 315/169.1
2003/0184236 A1 * 10/2003 Maede et al. ..... 315/169.1

FOREIGN PATENT DOCUMENTS

| | | |
|---|---|---|
| JP | 9-232074 | 9/1997 |
| JP | 10-112391 | 4/1998 |
| JP | 2001-42827 | 2/2001 |
| JP | 2001-143867 | 5/2001 |

* cited by examiner

*Primary Examiner*—Amare Mengistu
*Assistant Examiner*—Jennifer Zubajlo
(74) *Attorney, Agent, or Firm*—Mattingly, Stanger, Malur & Brundidge, PC

(57) ABSTRACT

A transistor for detecting current generated by an output side transistor of a current mirror circuit of an organic EL panel drive circuit and a control circuit including a current driven input stage and an output stage for driving the input side transistor of the current mirror circuit are provided. The input stage of the control circuit receives the detected current and a certain reference current and the output stage of the control circuit generates a drive current, which corresponds to a difference between the detected current and the certain reference current and drives the input side transistor of the current mirror circuit. The control circuit controls the detected current in such a manner that it becomes equal to the reference current and the current distributed to terminal pins of an organic EL panel becomes the reference current or a current corresponding thereto.

15 Claims, 3 Drawing Sheets

ORGANIC EL PANEL DRIVE CIRCUIT AND ORGANIC EL DISPLAY DEVICE

BACKGROUND OF THE INVENTION

1. Field of the Invention

The present invention relates to an organic EL element drive circuit and an organic EL display device using the same organic EL element drive circuit. In particular, the present invention relates to an organic EL element drive circuit capable of reducing variation of drive current in a driver IC for current-driving an organic EL panel for use in a portable telephone set, etc., and reducing luminous variation on a screen of an organic EL display device due to difference in characteristics between driver ICs and, particularly, suitable for a high luminous color display and an organic EL display device using the same organic EL element drive circuit.

2. Description of the Related Art

Since an organic EL display device can perform a high luminance display due to spontaneous light emission, the organic EL display device is suitable for use in a display device whose display screen size is small and is expected as the next generation display device to be mounted on such as a portable telephone set, a DVD player or a PDA (personal digital assistance), etc. A known problem of the organic EL display device is that variation of luminance becomes considerable when a voltage drive is applied to the organic EL display device as in a liquid crystal display device and the drive control becomes difficult due to the difference in sensitivity between R (red), G (green) and B (blue).

In view of this problem, an organic EL display device using a current driver is proposed recently. For example, in JP H10-112391A, a technique for solving the problem of luminance variation by employing the current drive is disclosed.

In a recent organic EL display panel of a passive type organic EL display device for use in a portable telephone set, the number of terminal pins of column lines (anode side drive lines of organic EL elements) is 396 (132×3) and the number of terminal pins of row lines is 162. These numbers of the terminal pins are still increasing.

With such increase of the number of terminal pins, the number of column IC drivers is three currently and the number of terminal pins of each driver for one of R, G and B display colors in the case of QVGA full color display is 120, so that the total number of the terminal pins of the three drivers becomes 360. Therefore, there is a problem that luminance variation occurs on a screen of an organic EL display device due to difference in characteristics between the column IC drivers, particularly, due to variation of drive circuits thereof.

For example, JP2001-42827A discloses a technique for solving the above problem.

FIG. 3 is a circuit diagram disclosed in JP2001-42827A. In FIG. 3, an initial stage column IC driver (anode line drive circuit as a master chip) 21 includes a reference current control circuit RC, a control current output circuit CO, a switch block SB having switches S1 to Sm and circuits composed of transistors Q1 to Qm and bias resistors R1 to Rm and provided correspondingly to the terminal pins as in current drive sources. A next stage column driver IC (a second anode line drive circuit of a slave chip) 22 includes a reference current control circuit CC, a switch block SB having switches S1 to Sm and circuits composed of transistors Q1 to Qm and bias resistors R1 to Rm and provided correspondingly to the terminal pins as m current drive sources. The m current drive sources are constructed with transistors Q1 to Qm and resistors R1 to Rm, respectively. Output currents i of the transistors Q1 to Qm of the drivers are supplied to the pins through the switches S1 to Sm and output terminals X1 to Xm, respectively.

The reference current control circuit RC is constructed with an operational amplifier OP supplied with a reference voltage VREF, a transistor Qa, which is driven by an output of the operational amplifier OP supplied to a base thereof, a resistor Rp provided between an emitter of the transistor Qa and ground and a transistor Qb having collector connected to a collector of the transistor Qa on an upstream side of the transistor Qa. A voltage generated by the resistor Rp is fed back to an input of the operational amplifier OP, so that the reference current control circuit constitutes a constant current source. An emitter of the transistor Qb is connected to a power source line VBE (corresponding to a power source line VDD of the display device) through a resistor Rr.

A current mirror circuit is constructed with the transistor Qb as an input side transistor and the transistors Q1 to Qm and a transistor Qo of the control current output circuit CO as output side transistors. The transistor Qb is driven by a reference current IREF generated by the reference current control circuit RC.

The drive current control circuit CC of the column driver IC 22 corresponds to the reference current control circuit RC. The drive current control circuit CC is constructed with a current mirror circuit including transistors Qc and Qd and a transistor Qe driven by the output side transistor Qd of the current mirror circuit. The input side transistor Qc of the column driver IC 22 is supplied with an output current Iout=ic of the control current output circuit CO of the column driver IC 21 to drive the transistor Qe of the column driver IC 22. The transistor Qe of the column driver IC 22 is an input side transistor of a current mirror circuit constituted with the transistors Q1 to Qm. Resistance values of the resistors Ro and Rr are equal and a resistance value of the resistor Rs is equal to a value of the parallel resistors R1 to Rm. The switches S1 to Sm of the switch block SB of the column driver IC 21 are ON/OFF controlled by control signals GA1 to GAm and the switches S1 to Sm of the switch block SB of the column driver IC 22 are ON/OFF controlled by control signals GB1 to GBm.

As another organic EL drive circuit having a construction similar to that shown in FIG. 3, a pair of current mirror circuits having an input side transistor and output side transistors are provided in a position corresponding to the switch block SB. In the current drive circuit, input side transistors are provided correspondingly to terminal pins and. The switching operation of the current drive circuit is ON/OFF controlled by the control signals GA1 to GAm.

Further, JPH9-232074A and JP2001-143867A disclose techniques, in each of which a D/A converter circuit is provided in an upstream side of a current mirror output circuit such as shown in FIG. 3 and generates drive currents for the respective terminal pins by D/A converting the display data for column side terminal pins of an organic EL display device.

A problem of the current drive circuit, in which the current mirror circuit for driving a plurality of output side transistors in parallel is used in the drive stage or the output stage will be described with reference to the column driver ICs 21 and 22 shown in FIG. 3.

In the organic EL drive circuit shown in FIG. 3, the output current Iout=ic of the transistor Qo of the column driver IC circuit 21 is supplied to the transistor Qe of the column driver IC 22 through the current mirror transistors Qc and Qd. Therefore, the output current i of the current mirror circuit is equal to the reference current IREF theoretically. However, even if the reference currents of the chips are made equal in this manner, characteristics (hfe and Early voltage, etc.) of transistors of the D/A converter circuits and the output circuits in the chips may be different. Therefore, it is difficult to make actual output currents of the chips precisely equal to each other. Further, since the reference current i is generated by the column driver IC 22 on the basis of the current Iout, which is one of the output drive currents of the column driver IC 21, a difference between the reference current i of the column driver IC 22 and the reference current IREF of the column driver IC 21 becomes large, so that the luminance variation in a boarder region on a display screen corresponding to an area between adjacent column driver ICs can not be removed sufficiently.

JP2003-28804SA entitled "Organic EL Drive Circuit and Organic EL Display Device" discloses a technique for solving such problem.

In the technique disclosed therein, a pair of resistors are provided within a column driver IC. A current from an output stage current source is supplied to one of the paired resistors and a current from an output current source of an upstream side column driver IC is supplied to the other resistor of the paired resistors. Voltages generated by the resistors according to these currents are compared with each other by an operational amplifier OP and the currents of the output stage current sources of the column driver IC are controlled to make them equal to each other by feeding back the currents in such a way that the voltages of the resistors become equal to each other.

On the other hand, due to the increase of the number of terminal pins, drive current variation between terminal pins becomes considerable. Therefore, more precisely defined drive currents are required. In view of this requirement, a problem occurs in the drive current control technique, in which paired resistors are utilized. That is, variation in resistance value of paired resistors influences on the drive current.

Particularly, when the drive current becomes smaller, an area of the paired resistors is increased necessarily, so that an area occupied by the column driver IC having such paired resistors is increased.

In the active matrix type current drive circuit, the drive current of an organic EL element is generated by charging a capacitor of a pixel circuit, which is, for example, several hundreds pF, with a current in a range from 0.1μA to 10μA. Therefore, requirements of S/N ratio and of preciseness of the drive current of the active matrix type organic EL drive circuit become more severe than those of the passive matrix type organic EL drive circuit.

SUMMARY OF THE INVENTION

An object of the present invention is to provide an organic EL drive circuit capable of reducing variation of drive current in a driver IC thereof for current-driving an organic EL panel.

Another object of the present invention is to provide an organic EL drive circuit capable of reducing luminous variation on a screen of an organic EL display device due to difference in characteristics between driver ICs for current-driving an organic EL panel.

A further object of the present invention is to provide an organic EL display device capable of reducing luminous variation of a screen of an organic EL display device due to difference in characteristics between driver ICs for current-driving an organic EL panel.

In order to achieve the above mentioned objects, an organic EL drive circuit according to the present invention is featured by comprising a first current mirror circuit including an input side transistor supplied with a predetermined drive current and a plurality of output side transistors for generating output currents to be distributed to a plurality of output pins provided correspondingly to terminal pins of an organic EL panel, a first transistor (output current detecting transistor) for generating a first current corresponding to the output current of the output side transistor by current-mirror connection to the input side transistor of the first current mirror circuit or by receiving an output current of the output side transistor and a control circuit including an input stage driven by the first current and a certain reference current and an output stage for generating the predetermined drive current corresponding to a difference between the first current and the certain reference current, for controlling the first current in such a manner that the first current becomes substantially equal to the certain reference current by driving the input side transistor by the output stage.

In the present invention, the first transistor (output current detecting transistor) is provided for the output side transistors of the first current mirror circuit and the control circuit includes the current-driven input stage and the output stage for driving the input side transistor of the first current mirror circuit. The input stage of the control circuit generates a drive current corresponding to the difference between the first current as a detected current and the reference current to drive the input side transistor of the first current mirror circuit. The control circuit controls the current to be distributed to the terminal pins in such a manner that it becomes equal to the reference current or a current corresponding to the reference current.

Therefore, there is no need of proving a resistor circuit in the input side of the control circuit, so that the organic EL drive circuit is not influenced by variation of resistance value of the resistor circuit. Therefore, it is possible to precisely make the output current of the output side transistor equal to the reference current or the current corresponding thereto.

Further, the precise output currents of the output side transistors or currents corresponding thereto are outputted externally of the column driver IC and used as a reference current of a next stage, that is, a slave driver IC. When the slave driver IC has the same circuit construction as that of the master, that is, first stage driver IC, it is possible to precisely control the output currents of the output side transistors of the slave driver IC to the reference current or current corresponding to the reference current. Thus, variation of the drive currents outputted to the respective terminal pins is reduced to thereby supply totally highly precise drive currents to the terminal pins.

As a result, it becomes possible to reduce variation of drive current in a column driver IC for driving an organic EL panel of a portable telephone set, etc., even when the number of terminal pins is increased and, further, it becomes possible to reduce luminous variation on a screen of an organic EL panel due to difference in characteristics between the column driver ICs for driving the organic EL panel.

DETAILED DESCRIPTION OF THE PREFERRED EMBODIMENTS

Figure 1:
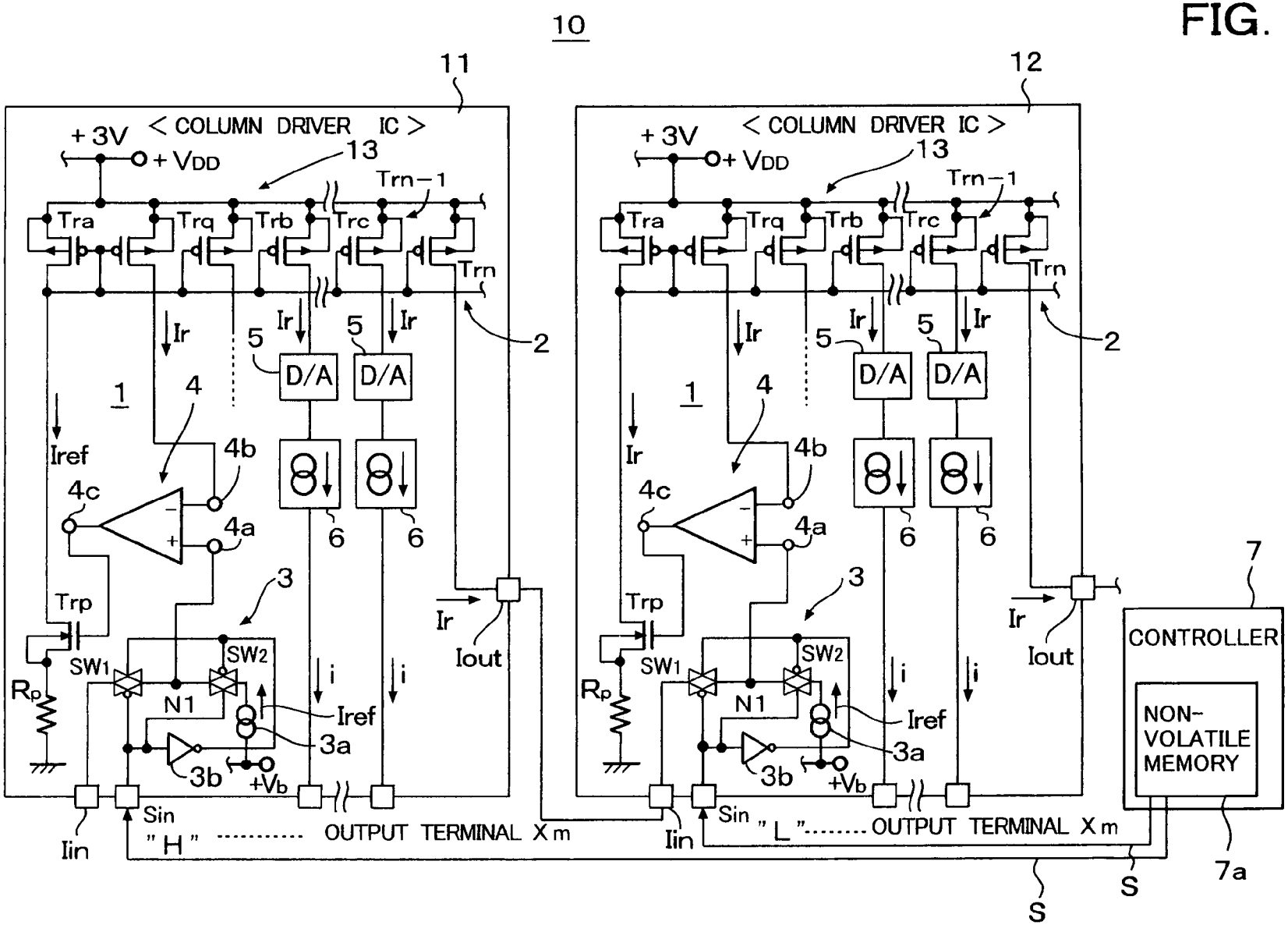
FIG. 1 is a circuit diagram of a column driver of a passive matrix type organic EL panel according to an embodiment of the present invention.

FIG. 1 is a circuit diagram of a column driver of an organic EL panel, according to an embodiment of the present invention. In FIG. 1, an organic EL panel drive circuit 10 includes column driver ICs 1 and 12.

Each of the column driver ICs 11 and 12 includes a reference current generator circuit 1 and a current output circuit 2.

The column driver IC 11 is a master chip column driver and the column driver IC 12 is a slave chip column driver and has substantially the same circuit construction as that of the column driver IC 11.

Differences between the column driver ICs 11 and 12 are that ON/OFF operation of analog switches (transmission gates) of the drivers 11 and 12, which are connected to input terminals Iin, are opposite, that the master chip driver IC 11 supplies a reference drive current Ir, which corresponds to a reference current Iref generated by the reference current generator circuit 1 of the column driver IC 11, to the slave chip driver IC 12 and that the slave chip driver IC 12 operates upon a current corresponding to the reference drive current Ir from the master chip driver IC 11.

The column driver ICs 11 and 12 will be described in the following description. However, it should be noted that, when three or more driver ICs are connected in series, each of the third and following driver ICs operates similarly to the slave driver IC 12.

Each of the driver ICs 11 and 12 includes a series circuit 3 including analog switches SW1 and SW2 and a reference current source 3*a*. The series circuit 3 is provided between the input terminal Iin and a bias line +Vb. The reference current source 3*a* is supplied with power from the bias line +Vb and generates a reference current Iref.

When the upstream side analog switch SW1 of the series circuit 3 of the master chip driver 11 is in OFF state, the downstream side analog switch SW2 thereof is in ON state. On the other hand, when the upstream side analog switch SW1 of the series circuit 3 of the slave chip driver IC 12 is ON state, the downstream side analog switch SW2 thereof is in OFF state. Non-inversion and inversion sides of control terminals (gate input terminals) of these switches SW1 and SW2 are connected to a control signal input terminal Sin directly and through an inverter 3*b*, respectively, in such a manner that the states of the switches SW1 and SW2 are always opposite to each other. That is, the switches SW1 and SW2 are complementarily driven.

When a setting signal S supplied from a controller 7 to one of the column driver ICs 11 and 12 through a control signal input terminal Sin is high (H) level, the switches SW1 and SW2 of the one column driver IC are turned OFF and ON, respectively, and, when the setting signal S is in low (L) level, the switches SW1 and SW2 are turned ON and OFF, respectively. In the embodiment shown in FIG. 1, the column driver IC 11 becomes the master chip driver when the control signal at the input terminal Sin is H and the column driver IC 12 becomes the slave chip driver when the control signal is L.

The switches SW1 and SW2 and the inverter 3*b* constitute a selector circuit for selecting either one of the currents from the input terminal Iin and the reference current Iref generated by the reference current source 3*a*.

The controller 7 includes a non-volatile memory 7*a*, 1 bit of which is assigned to data of the setting signal S for each of the column driver ICs and the setting signal S for the respective driver chips are derived from the non-volatile memory 7*a*. That is, the non-volatile memory 7*a* includes bit areas corresponding in number to column driver ICs used as the respective column drivers. The data are written in the bit areas of the non-volatile memory 7*a* in a fabrication step of the drive circuit as a ROM or after the fabrication step by a MPU, etc. Incidentally, the non-volatile memory 7*a* may be replaced by a volatile memory. In such case, the bit data may be written therein from another non-volatile memory.

In the following description, the column driver IC 11 will be described in detail. As to the column driver IC 12, only operational differences thereof from the column driver IC 11 will be described. The control circuit 1 of the column driver IC 11 includes a differential amplifier 4 having an input stage directly driven by a current inputted to a (+) input terminal 4*a* and a (−) input terminal 4*b* of the differential amplifier 4, and a series circuit of an N channel MOS FET Trp and a resistor Rp connected to an output terminal 4*c* of the differential amplifier 4. The transistor Trp has a gate connected to the output terminal 4*c* of the differential amplifier 4 and is driven by a voltage output at the output terminal 4*c*. The resistor Rp has one end connected to a source of the transistor Trp and the other end grounded. In an upstream side of the transistor Trp, an input side P channel MOS FET Tra of the current mirror circuit 13 is provided. A drain of the transistor Trp is connected to a drain of the transistor Tra, so that the transistor Tra is driven by the reference current Iref.

Figure 2:
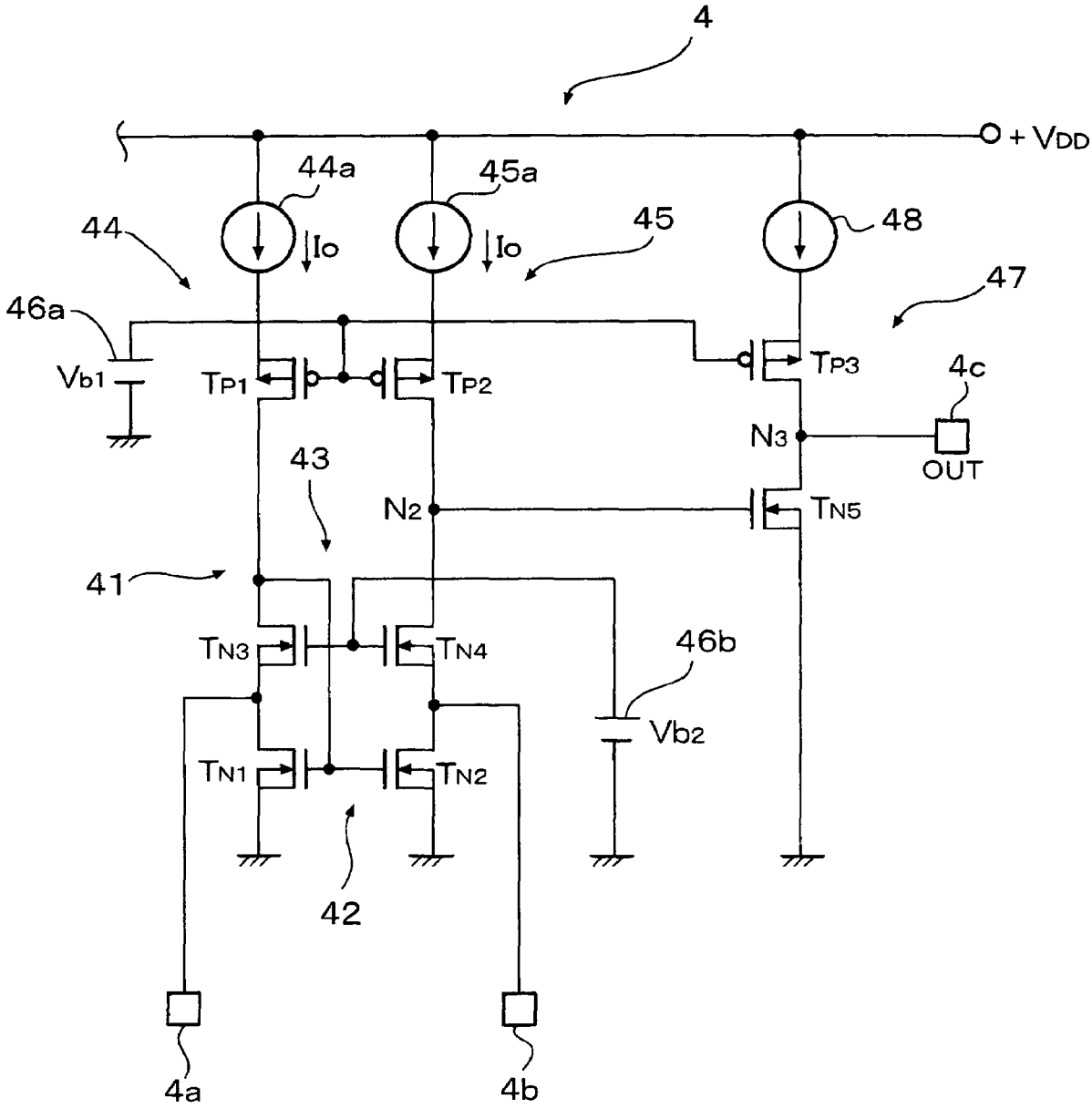
FIG. 2 is a circuit diagram of an example of a differential amplifier of the column driver shown in FIG. 1.
Figure 3:
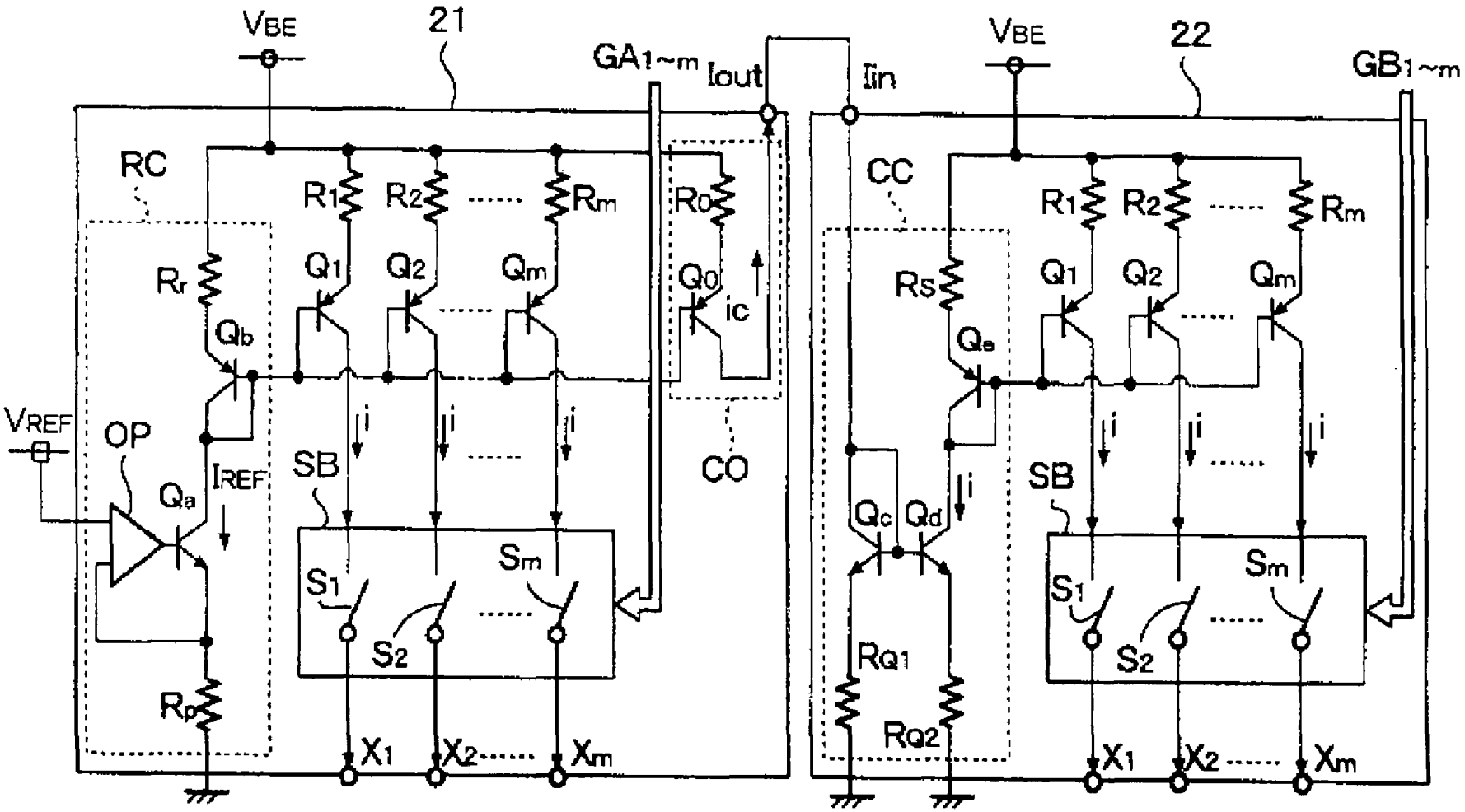
FIG. 3 PRIOR ART
FIG. 3 is a circuit diagram of an example of a conventional organic EL drive circuit.

Unlike the operational amplifier OP shown in FIG. 3, the differential amplifier 4 has the input stage, which is constructed with a plurality of current mirror circuits and current-driven by the input currents as shown in FIG. 2. The construction and operation of the differential amplifier 4 will be described in detail later.

The current mirror circuit 13 functions to distribute the reference current to the respective terminal pins. The current mirror circuit 13 includes an input side transistor Tra and output side transistors Trb to Trn. Further, a P channel MOS FET Trq is connected to the input side transistor Tra and, together with the transistor Tra, constitute a current mirror circuit. The transistor Trq is arranged in a closer position than said output side transistors to the input side transistor Tra. Sources of the transistors Trb to Trq are connected to a power source line +VDD (+3V). When the present invention is applied to the active type organic EL drive circuit, the sources of the transistors Trb and Trq are connected to a power source line +Vcc (+5.5V). The gate width ratio (channel width ratio) of each of the output side transistors Trq and Trb to Trn to the input side transistor Tra is 1:1. The transistors Trb to Trn−1 output the reference currents Ir to be distributed to the respective terminal pins and the output current of the transistor Trn is outputted externally of the column driver IC 11.

The output current Ir from the drain of each of the transistors Trb to Trn is substantially equal to the output current from the drain of the transistor Trq.

The (+) input terminal 4*a* of the differential amplifier 4 is connected to a connecting point N1 between the switches SW1 and SW2. In the master chip driver IC in which the switch SW2 is in ON state, the (+) input terminal 4*a* of the differential amplifier 4 receives the reference current Iref from the reference current source 3*a* through the switch SW2. The (−) input terminal 4*b* of the differential amplifier 4 is connected to the drain of the transistor Trq. The transistor Trq constitutes a current monitor circuit for monitoring the output current Ir from the drain of each of the transistors Trb to Trn. That is, the transistor Trq is an output current detecting transistor for the transistors Trb to Trn and generates the output current Ir as a detected current at the drain thereof.

The drains of the output side transistors Trb to Trn of the current mirror circuit 13 are connected to D/A converter circuits 5, respectively. The reference currents Ir are used as reference drive currents of the respective D/A converter circuits 5. In response to display data, the D/A converter circuits 5 generate the drive currents Ir corresponding to display luminance and the respective output stage current sources 6 are driven thereby. Each output stage current source 6 is constructed with a current mirror circuit including a pair of transistors and the drive currents i from the output stage current sources 6 are supplied to the terminal pins of the organic EL panel through the output terminals X1 to Xm, respectively.

The drain of the last output stage transistor Trn is connected to an external output terminal Iout of the column driver IC 11 and the output current is sent externally of the column driver IC 11 through the output terminal Iout to the input terminal Iin of the slave driver IC 12. Thus, the transistor Trn becomes a current output circuit to the next stage.

The output current of the transistor Trq is inputted to the (−) input terminal 4*b* of the differential amplifier 4 and an output voltage of the differential amplifier 4 is inputted to a gate of the transistor Trp. The output of the transistor Trp is fed back to the transistor Trq. As a result, the current of the transistor Trq becomes substantially equal to the current inputted to the (+) input terminal 4*a* of the differential amplifier 4, so that the current Ir becomes equal to the reference current Iref.

Therefore, when the transistors constituting the differential amplifier 4, the transistor Trq, the transistor Tra and the transistors Trb to Trn of the column driver IC 11 have good paring characteristics, output currents Ir of the output side transistors Trq and Trb to Trn are controlled in such manner that the current Ir becomes equal to the reference current Iref of the reference current source 3*a* and the thus controlled currents Ir are outputted to the respective D/A converter circuits 5 as drive currents and further outputted externally of the column driver IC 11 through the output terminal Iout.

The input terminal Iin of the slave chip column driver 12 is connected to the external output terminal Iout of the column driver IC 11 so that the latter receives the current Ir (=Iref) from the transistor Trn of the current output circuit 2 of the column driver IC 11. Therefore, the column driver IC 12 generates reference currents corresponding to the respective terminal pins by the current mirror circuit 13 thereof.

With the setting signal S in L level at the input terminal Iin of the column driver IC 12, the switches SW1 and SW2 thereof are turned ON and OFF, respectively. Therefore, the output current Ir of the column driver IC 11 is inputted to the (+) input terminal 4*a* of the differential amplifier 4 of the column driver IC 12 and the transistor Trp of the current mirror circuit 13 of the column driver IC 12 is driven by the output voltage of the differential amplifier 4. Thus, the input side transistor Tra of the current mirror circuit 13 of the driver IC 12 is driven and output currents Ir are generated by the output side transistors Trb to TRn of the current mirror circuit 13 thereof. The respective D/A converter circuits 5 are driven by the output currents Ir thus generated and the output stage current sources 6 corresponding thereto generate the drive currents i at the output terminals X1 to Xm.

The drain of the transistor Trn of the current mirror circuit 13 of the driver IC 12 is connected to an external output terminal Iout and outputs an output current Ir externally of the driver IC 12 through the external output terminal Iout.

Since the driver IC 12 is similar to the driver IC 11, the output current Ir of each of the transistors Trb to Trn of the current mirror circuit 13 of the driver IC 12 becomes substantially equal to the reference current Iref on the (+) input terminal 4*a* of the differential amplifier 4. The output current Ir is an output current from the output side transistor Trn of the current mirror circuit 13 of the column driver 11 and is controlled to the reference current Iref of the reference current source 3*a* of the driver 11. As a result, the output current of each of the transistors Trb to Trn of the driver IC 12 is controlled in such a manner that it becomes substantially equal to the reference current Iref of the reference current source 3*a* of the driver IC 11.

That is, when the transistors constituting the differential amplifier 4, the transistor Trq, the transistor Tra and the transistors Trb to Trn of the driver IC 12 have good paring characteristics, output currents Ir of the output side transistors Trq and Trb to Trn are controlled in such manner that the current Ir becomes equal to the reference current Iref of the reference current source 3*a* even if the paring characteristics is different from that of the driver IC 11 and that the thus controlled currents Ir are outputted to the respective D/A converter circuits 5 as drive currents and further outputted externally of the driver IC 11 through the output terminal Iout.

FIG. 2 is a circuit diagram of the differential amplifier 4 having an input stage, which is directly driven by the input currents.

In FIG. 2, the input stage of the differential amplifier 4 is constructed with a cascade-connected current mirror circuit 41 and an output stage amplifier 47.

In detail, the current mirror circuit 41 includes current mirror circuits 42 and 43 and constant current sources 44 and 45 integrated in this order between a power line +VDD and ground.

The current mirror circuit 42 is constructed with N channel MOS transistors TN1 and TN2 and the current mirror circuit 43 is constructed with N channel MOS transistors TN3 and TN4. The current source 44 is constructed with a P channel MOS transistor TP1 and a constant current source 44*a* and the current source 45 is constructed with a P channel MOS transistor TP2 and a constant current source 45*a*.

The P channel MOS transistor TP1 of the current source 44 is connected to the power line +VDD through the constant current source 44*a* and operates with a bias current Io from the constant current source 44*a*. The P channel MOS transistor TP2 of the current source 45 is connected to the power line +VDD through the constant current source 45*a* and operates with a bias current Io from the constant current source 45*a*. Gates of the MOS transistors TP1 and TP2 are connected commonly and supplied with a bias voltage Vb1 from a bias circuit 46*a*.

The transistors TN3 and TN4 of the current mirror circuit 43 are supplied with bias currents from the transistors TP1 and TP2, respectively. Gates of the transistors TN3 and TN4 are connected commonly and supplied with bias voltage Vb2 from a bias circuit 46*b*.

Gates of the transistors TN1 and TN2 of the current mirror circuit 42 are connected commonly to the drain of the transistor TN3 and drains of the transistors TN1 and TN3 are connected to the (+) input terminal 4*a* and the (−) input terminal 4*b* of the differential amplifier 4, respectively.

The current mirror circuit 41 is in a steady stage when the bias current Io flows through the current mirror connected transistors TN1 and TN2 and outputs a current corresponding to a difference between a current inputted to the transistor TN1 and a current inputted to the transistor TN2 with reference to the bias current Io.

The output of the current mirror circuit 41 is derived from a connecting point N2 between the drains of the transistors TP2 and TN4 and inputted to an output stage amplifier 47. The output stage amplifier 47 is constructed with a series connection of a P channel MOS transistor TP3 and an N channel MOS transistor TN5 provided between the power line +VDD and ground and a connecting point N3 of drains of these transistors is connected to the output terminal 4*c* of the differential amplifier 4.

The transistor TP3 has a source connected to the power line +VDD through a constant current source 48 and a gate connected to the bias circuit 46*a*. Therefore, the transistor TP3 also functions as a constant current source. A current from this constant current source is supplied to a drain of a transistor TN5. The transistor TN5 amplifies the voltage signal from the connecting point N2 and supplies the thus amplified voltage signal to the output terminal 4*c* of the differential amplifier 4.

The source of the transistor TN5 is grounded and a gate thereof connected to the connecting point N2 receives the output voltage of the current mirror circuit 41.

Thus, the transistor TN5 generates a voltage having phase, which is inverted according to the gate voltage thereof, at the output terminal 4*c* of the differential amplifier 4. On the other hand, the current inputted to the (+) input terminal 4*a* of the differential amplifier 4 results in a current output at the connecting point N2, which is the output terminal of the current mirror circuit 41. However, since the connecting point N2 is connected to the gate of the transistor TN5, there is no current generated and the output voltage, which is opposite in-phase with the input current to the (+) input terminal 4*a*, is generated at the connecting point N2. This opposite phase output voltage is inputted to the gate of the transistor TN5, resulting in an output voltage at the output terminal 4*c*, which is in-phase with the input current to the (+) input terminal 4*a*.

When a current in phase with the output voltage at the output terminal 4*c* is fed back to the (−) input terminal 4*b*, the differential amplifier 4 operates as a negative feedback circuit and the input and output currents are balanced in the steady state due to the current mirror connection of the transistors TN1 and TN2. Therefore, when a difference in current occurs between the input side transistor TN1 and the output side transistor TN2, a current corresponding to the difference is negatively fed back to the output side transistor TN2 and the voltage of the connecting point N2 is set in such a manner that the current in the output side transistor TN2 becomes equal to that in the input side transistor TN1, so that a control is performed to make the current in the (−) input terminal 4*b* equal to the current in the (+) input terminal 4*a* by the feedback current.

Incidentally, since the differential amplifier 4 has the input stage, which is current-driven, it is possible to generate a current corresponding to the difference in current between the (+) input terminal 4*a* and the (−) input terminal 4*b* at the connecting point N2 by directly comparing them each other, without converting the input current into a voltage by a resistor. Therefore, it is possible to drive the input side transistor Tra of the current mirror circuit 13 without influence of resistance variation of the resistor for current-voltage conversion. As a result, it is possible to generate highly precise drive currents to be outputted to the terminal pins.

Since, in the current mirror circuit 13 of this embodiment, the gate width ratio (channel width ratio) of each of the transistors Trq and Trb to Trn to the input side transistor Tra is 1:1, the reference current Iref obtained by the differential amplifier 4, the output current of the transistor Trq and the output current of each of the transistors Trb to Trn become in the same level. Therefore, the detection accuracy of the output currents of the output side transistors of the current mirror circuit 13 becomes high.

Further, the current of the output side transistor Trn, which is one of the output side transistors of the current mirror circuit (reference current distribution circuit) 13, is externally outputted and is used as a drive current for controlling the gate voltage of each of the output side transistors of the current mirror circuit 13 of the next slave chip (the next stage driver IC) through the control circuit 1 of the next slave chip (the next stage driver IC).

Therefore, the variation of reference drive currents distributed to the respective terminal pins is reduced, so that the variation of the output currents at the terminal pins is improved.

Incidentally, when the gate width ratio of the input side transistor Tra, the output side transistor Trq and each of the output side transistors Trb to Trn is 1:n:1, it is possible to generate drive currents each being (1/n)×(reference current Iref) at the output side transistors Trb to Trn, respectively. On the contrary, when the gate width ratio of the input side transistor Tra, the output side transistor Trq and each of the output side transistors Trb to Trn is n:1:n, it is possible to generate drive currents each being (n)×(reference current Iref) at the output transistors Trb to Trn, respectively. Therefore, in the present invention, the gate width ratio of the transistor Trq and each of the transistors Trb to Trn to the input side transistor Tra is not limited to 1:1.

Further, although current preciseness may be lowered some extent, a current corresponding to the output current of each of the transistors Trb to Trn−1, for example, the current of the output stage current source 6 or a portion thereof can be fed back to the (−) input terminal 4*b* of the differential amplifier 4, without using the transistor Trq.

In this embodiment, one of the output side transistors of the current mirror circuit 13 of the preceding driver is used as the current output circuit to the next stage driver IC. However, it is not always necessary to use the output current of one of the output side transistors of the current mirror circuit 13 for the next stage driver IC because any current can be used for the next stage driver IC, provided that it corresponds to the reference current for generating the drive current for driving the output pins of the organic EL panel.

In the embodiment, the current mirror circuit 13 generates the current equal to the reference current Iref and distributes the currents to the respective terminal pins. However, the current mirror circuit 13 may be constructed such that it distributes current K×Iref corresponding to the reference current Iref to the D/A converter circuits, etc.

In the described embodiment, the current mirror circuit 13 has a number of output side transistors, which are current mirror connected to the single input side transistor Tra. However, the single input side transistor Tra may be not critical and a plurality of input side transistors may be used. Further, the single input side transistor Tra may be arranged in a center position of the output side transistors.

Although the organic EL drive circuit according to the present invention is constructed mainly with MOS FETs, it is, of course, possible to construct the organic EL drive circuit with bipolar transistors.

Further, the N channel type (or npn type) transistors may be replaced by P channel (or pnp type) transistors, or vice versa.

Particularly, in FIG. 2, the input terminals 4*a* and 4*b* of the current mirror circuit 41 can be exchanged by replacing the P channel transistors by N channel transistors and replacing the N channel transistors by P channel transistors. In such case, the feedback current can be derived from the input terminal 4*a*.

What is claimed is:

1. An organic EL panel drive circuit comprising:

a first current mirror circuit including an input side transistor supplied with a predetermined drive current and a plurality of output side transistors each for generating an output current to be distributed to a corresponding terminal pin of an organic EL panel;

a first transistor for generating a first current corresponding to the output current of said output side transistor by a current-minor connection to said input side transistor of said first current mirror circuit or by an output current of said output side transistor; and a control circuit including an input stage driven by the first current and a certain reference current and an output stage for generating the predetermined drive current corresponding to a difference between the first current and the certain reference current, for controlling the first current in such a manner that the first current becomes substantially equal to the certain reference current by driving said input side transistor by said output stage;

wherein said organic EL panel drive circuit is provided as an IC and generates a current substantially equal to the certain reference current according to the output current of each said output side transistor of said first current mirror circuit or a second current corresponding to the output current of said output side transistor of said first current mirror circuit and outputting the thus generated current externally of said IC;

wherein said control circuit includes a current-driven differential amplifier circuit and said input stage is an input stage of said differential amplifier circuit having a (+) input terminal and a (−) input terminal, the first current being inputted to either one of said (+) input terminal and said (−) input terminal and the certain reference current being inputted to the other of said (+) input terminal and said (−) input terminal.

2. The organic EL panel drive circuit as claimed in claim 1, wherein said input stage of said differential amplifier circuit is a second current mirror circuit having an input side transistor supplied with one of the first current and the certain reference current and an output side transistor supplied with the other of the first current and the certain reference current, a current or voltage corresponding to a difference between the first current and the certain reference current being generated by said output side transistor of said second current mirror circuit.

3. The organic EL panel drive circuit as claimed in claim 2, wherein said first current mirror circuit includes a second transistor current-mirror connected to said input side transistor for generating the second current, the second current is substantially equal to the certain reference current and the second current is outputted from said second transistor externally of said IC.

4. The organic EL panel drive circuit as claimed in claim 3, wherein said output stage includes a third transistor, said differential amplifier circuit is constructed with said second current mirror circuit and an output stage amplifier, said output stage amplifier generates an output voltage corresponding to an output current of said second current mirror circuit, said third transistor is driven by the output voltage of said output stage amplifier and said input side transistor of said first current mirror circuit is driven by said third transistor.

5. The organic EL panel drive circuit as claimed in claim 4, further comprising a reference current generator circuit for generating the certain reference current and a selector circuit, wherein said selector circuit selects either one of a third current supplied externally of said IC and the certain reference current, the third current becomes the certain reference current and is sent to one of said input side transistor of said second current mirror circuit and said output transistor of said second current mirror circuit when said selector circuit selects the third current.

6. The organic EL panel drive circuit as claimed in claim 5, wherein the third current is substantially equal to the certain reference current.

7. The organic EL panel drive circuit as claimed in claim 6, wherein, when said selector circuit selects the certain reference current, said organic EL panel drive circuit becomes a master driver for sending the second current externally of said IC as the third current and, when said selector circuit selects the third current, said organic EL panel drive circuit becomes a slave driver for generating the first current according to the third current.

8. The organic EL panel drive circuit as claimed in claim 7, wherein said IC includes a first IC as said master driver and a second IC as said slave driver having the same construction as that of said first IC, said first current mirror circuit of said first and second ICs are constructed with P channel transistors and said first and second transistors are P channel transistors, said second current mirror circuit is constructed with N channel transistors, said first transistor is arranged in a closer position than said output side transistors and current-mirror connected to said input side transistor thereof, said second transistor is arranged in a last position of said output side transistors of said first current mirror circuit and said third transistor has a drain connected to a drain of said input side transistor of said first current mirror circuit and a source grounded through a resistor.

9. The organic EL panel drive circuit as claimed in claim 8, further comprising a plurality of D/A converter circuits supplied with output currents of said output side transistors of said first current mirror circuit and a plurality of current sources, said current sources being responsive to output currents of said D/A converter circuits to generate drive currents to be supplied to said terminal pins, respectively, wherein gate width ratio of said input side transistor of said first current mirror circuit to said first transistor is substantially 1:1 and the first current is substantially equal to the output current of each of said output side transistors of said first current mirror circuit.

10. The organic EL panel drive circuit as claimed in claim 9, wherein said organic EL panel is of the active matrix type and current sources drive pixel circuits provided in said organic EL panel.

11. An organic EL panel drive circuit comprising:

a first current mirror circuit including an input side transistor supplied with a predetermined drive current and a plurality of output side transistors each for generating an output current to be distributed to a corresponding terminal pin of an organic EL panel;

a first transistor for generating a first current corresponding to the output current of said output side transistor by a current-mirror connection to said input side transistor of said first current mirror circuit or by an output current of said output side transistor; and a control circuit including an input stage driven by the first current and a certain reference current and an output stage for generating the predetermined drive current corresponding to a difference between the first current and the certain reference current, for controlling the first current in such a manner that the first current becomes substantially equal to the certain reference current by driving said input side transistor by said output stage;

wherein said organic EL panel drive circuit is provided as an IC and generates a current substantially equal to the certain reference current according to the output current of each said output side transistor of said first current mirror circuit or a second current corresponding to the output current of said output side transistor of said first current mirror circuit and outputting the thus generated current externally of said IC;

further comprising a second transistor, wherein said first and second transistors are connected in parallel to said output side transistors and the current outputted externally of said IC is outputted from said second transistor; and wherein said control circuit includes a current-driven differential amplifier circuit and said input stage includes a (+) input terminal and a (−) input terminal of said differential amplifier circuit and the first current is inputted to either one of said (+) input terminal and the (−) input terminal and the reference current is inputted to the other input terminal.

12. An organic EL display device comprising a driver IC including an organic EL panel drive circuit, said organic EL panel drive circuit comprising:

a first current mirror circuit including an input side transistor supplied with a predetermined drive current and a plurality of output side transistors each for generating an output current to be distributed to a corresponding terminal pin of an organic EL panel;

a first transistor for generating a first current corresponding to the output current of said output side transistor by a current-mirror connection to said input side transistor of said first current mirror circuit or by an output current of said output side transistor; and a control circuit including an input stare driven by the first current and a certain reference current and an output stage for generating the predetermined drive current corresponding to a difference between the first current and the certain reference current, for controlling the first current in such a manner that the first current becomes substantially equal to the certain reference current by driving said input side transistor by said output stage;

wherein said organic EL panel drive circuit is provided as an IC and generates a current substantially equal to the certain reference current according to the output current of each said output side transistor of said first current mirror circuit or a second current corresponding to the output current of said output side transistor of said first current mirror circuit and outputting the thus generated current externally of said IC; and wherein said control circuit includes a current-driven differential amplifier circuit and said input stage is an input stage of said differential amplifier circuit having a (+) input terminal and a (−) input terminal, the first current being inputted to either one of said (+) input terminal and said (−) input terminal and the certain reference current being inputted to the other of said (+) input terminal and said (−) input terminal.

13. The organic EL display device as claimed in claim 12, wherein said input stage of said differential amplifier circuit is a second current mirror circuit having an input side transistor supplied with one of the first current and the certain reference current and an output transistor supplied with the other of the first current and the certain reference current, a current or voltage corresponding to a difference between the first current and the certain reference current being generated by said output side transistor of said second current mirror circuit.

14. The organic EL display device as claimed in claim 12, comprising a plurality of said driver ICs, wherein each driver IC includes a selector circuit for selecting either one of a third current supplied externally of said IC and the certain reference current, said driver IC becomes a master driver for sending a current corresponding to the certain reference current when said selector circuit selects the certain reference current and a slave driver for generating the first current according to the third current when said selector circuit selects the externally supplied current.

15. The organic EL display device as claimed in claim 14, wherein said IC includes a first IC as said master driver and a second IC as said slave driver having the same construction as that of said first IC, said first current mirror circuit of said first and second ICs are constructed with P channel transistors and said first and second transistors are P channel transistors, said second current mirror circuit is constructed with N channel transistors, said first transistor is arranged in a closer position than said output side transistors and current-mirror connected to said input side transistor thereof, said second transistor is arranged in a last position of said output side transistors of said first current mirror circuit and said third transistor has a drain connected to a drain of said input side transistor of said first current mirror circuit and a source grounded through a resistor.

* * * * *